US010923068B2

(12) United States Patent
Tsai et al.

(10) Patent No.: US 10,923,068 B2
(45) Date of Patent: Feb. 16, 2021

(54) DISPLAY DEVICE AND DISPLAY DRIVING CIRCUIT WITH ELECTROMAGNETIC INTERFERENCE SUPPRESSION CAPABILITY

(71) Applicant: E Ink Holdings Inc., Hsinchu (TW)

(72) Inventors: Xue-Hung Tsai, Taoyuan (TW); Wei-Tsung Chen, Nantou County (TW); Yu-Lin Wang, Changhua County (TW); Po-Hsin Lin, New Taipei (TW)

(73) Assignee: E INK HOLDINGS INC., Hsinchu (TW)

( * ) Notice: Subject to any disclaimer, the term of this patent is extended or adjusted under 35 U.S.C. 154(b) by 0 days.

(21) Appl. No.: 16/419,642

(22) Filed: May 22, 2019

(65) Prior Publication Data

US 2019/0362685 A1 Nov. 28, 2019

(30) Foreign Application Priority Data

May 22, 2018 (TW) ..... 107117342 A

(51) Int. Cl.
*G09G 3/36* (2006.01)

(52) U.S. Cl.
CPC ... *G09G 3/3688* (2013.01); *G09G 2300/0426* (2013.01); *G09G 2310/08* (2013.01); *G09G 2330/06* (2013.01)

(58) Field of Classification Search
CPC ..... G09G 2300/0426; G09G 2310/08; G09G 2330/06; G09G 3/3688
See application file for complete search history.

(56) References Cited

U.S. PATENT DOCUMENTS 920,135 A 5/1909 Harrod
6,215,477 B1 4/2001 Morrison et al.
(Continued)

FOREIGN PATENT DOCUMENTS

CN 2773988 4/2006
CN 101211042 A 7/2008
(Continued)

OTHER PUBLICATIONS

Chinese Office Action dated Jun. 18, 2020.

*Primary Examiner* — Temesghen Ghebretinsae
*Assistant Examiner* — Sosina Abebe
(74) *Attorney, Agent, or Firm* — Rabin & Berdo, P.C.

(57) ABSTRACT

A display device and a display driving circuit with electromagnetic interference suppression capability are provided. The display device includes a substrate, an active matrix, a display driver and a thin-film transistor (TFT) conditioning circuit. The active matrix disposed on the substrate includes multiple data lines, multiple gate lines and multiple pixels. The data lines intersect with the gate lines. The pixels are coupled to intersections of the data lines and the gate lines. The display driver disposed on the substrate generates signals for driving the data lines and/or the gate lines in response to a conditioned serial data clock. The TFT conditioning circuit disposed on the substrate is coupled to the display driver. The TFT conditioning circuit includes one or more TFTs, and attenuates an amplitude of a serial data clock in response to a predetermined gate bias to provide the conditioned serial data clock to the display driver.

10 Claims, 3 Drawing Sheets

(56) References Cited

U.S. PATENT DOCUMENTS

| | | | |
|---|---|---|---|
| 6,762,735 | B2 | 7/2004 | Koyama |
| 7,166,966 | B2 | 1/2007 | Naugler et al. |
| 7,535,466 | B2 | 5/2009 | Sampsell et al. |
| 7,561,152 | B2 | 7/2009 | Hori et al. |
| 7,773,063 | B2 | 8/2010 | Koyama |
| 7,800,600 | B2 | 9/2010 | Komatsu et al. |
| 7,898,510 | B2 | 3/2011 | Hori et al. |
| 7,919,975 | B2 | 4/2011 | Ryu |
| 7,940,231 | B2 | 5/2011 | Moriyama et al. |
| 7,978,613 | B2 | 7/2011 | Gray et al. |
| 8,115,505 | B2 | 2/2012 | Ryu |
| 8,179,358 | B2 | 5/2012 | Yajima et al. |
| 9,453,868 | B2 | 9/2016 | Kimata et al. |
| 9,495,928 | B2 | 11/2016 | Jiang et al. |
| 9,678,128 | B2 | 6/2017 | Choi et al. |
| 2001/0040565 | A1 | 11/2001 | Koyama |
| 2005/0200294 | A1 | 9/2005 | Naugler et al. |
| 2005/0200296 | A1 | 9/2005 | Naugler et al. |
| 2006/0132493 | A1 | 6/2006 | Akima |
| 2007/0002033 | A1 | 1/2007 | Komatsu et al. |
| 2007/0222474 | A1 | 9/2007 | Lauzun |
| 2007/0222710 | A1 | 9/2007 | Moriyama et al. |
| 2008/0136847 | A1 | 6/2008 | Yajima et al. |
| 2008/0238819 | A1 | 10/2008 | Ryu |
| 2008/0273132 | A1* | 11/2008 | Hsu ..... G02F 1/167 349/39 |
| 2010/0277458 | A1* | 11/2010 | Liu ..... G09G 3/3688 345/211 |
| 2011/0169792 | A1 | 7/2011 | Shimizu et al. |
| 2011/0255585 | A1 | 10/2011 | Lee |
| 2012/0018627 | A1 | 1/2012 | Tredwell et al. |
| 2015/0348485 | A1 | 12/2015 | Lee |
| 2016/0070386 | A1 | 3/2016 | Yamamoto et al. |
| 2018/0113561 | A1* | 4/2018 | Lu ..... G06F 3/044 |

FOREIGN PATENT DOCUMENTS

| | | | |
|---|---|---|---|
| CN | 101345016 | A | 1/2009 |
| CN | 101441857 | A | 5/2009 |
| CN | 101640948 | A | 2/2010 |
| JP | 2013074305 | A | 4/2013 |
| TW | 200509040 | A | 3/2005 |
| TW | 200703219 | A | 1/2007 |
| TW | 200931102 | A | 7/2009 |
| TW | 201039331 | A | 11/2010 |
| TW | 201732767 | A | 9/2017 |

* cited by examiner

DISPLAY DEVICE AND DISPLAY DRIVING CIRCUIT WITH ELECTROMAGNETIC INTERFERENCE SUPPRESSION CAPABILITY

This application claims the benefit of Taiwan application Serial No. 107117342, filed May 22, 2018, the subject matter of which is incorporated herein by reference.

BACKGROUND OF THE INVENTION

Field of the Invention

This disclosure relates to a display device and a display driving circuit, and more particularly a display device and a display driving circuit with electromagnetic interference (EMI) suppression capability.

Description of the Related Art

Electromagnetic interference (EMI) refers to the effect of electromagnetic energy of electronic signals on surrounding elements, devices, apparatuses and biological tissues. The serious EMI may cause malfunction of the electronic device and even endanger the health of the user. At present, the international community is paying more and more attention to EMI phenomenon of electronic products, and the electronic products are required to meet certain anti-EMI standards before becoming available in the market.

Taking the display device as an example, the display device can be sold in the market after passing the EMI test. However, as the resolution requirements of the display devices become higher and higher, the transmission rates of the display driver for transmitting data signals and scan signals must also be increased, thereby making the EMI phenomenon of the display device become more and more serious. In view of this, there is a need to propose an improved display technology to reduce the EMI of the display device.

SUMMARY OF THE INVENTION

This disclosure is directed to a display device and a display driving circuit, which can effectively reduce the EMI of the display device by properly attenuating a serial data clock (SDCLK) provided to a display driver, so that the display device can pass the EMI test.

According to one aspect of this disclosure, a display device is provided. The display device includes a substrate, an active matrix, a display driver and a thin-film transistor (TFT) conditioning circuit. The active matrix is disposed on the substrate and includes multiple data lines, multiple gate lines and multiple pixels, wherein the data lines intersect with the gate lines. The pixels are coupled to intersections of the data lines and the gate lines. The display driver is disposed on the substrate, and generates signals for driving the data lines and/or the gate lines in response to a conditioned serial data clock. The TFT conditioning circuit is disposed on the substrate and coupled to the display driver. The TFT conditioning circuit includes one or multiple thin-film transistors, and attenuates an amplitude of a serial data clock in response to a predetermined gate bias to provide the conditioned serial data clock to the display driver.

According to another aspect of this disclosure, a display driving circuit is provided. The display driving circuit is used to drive the active matrix of the display device. The display driving circuit includes a display driver and a TFT conditioning circuit. The display driver is disposed on the substrate, and generates signals for driving the active matrix in response to a conditioned serial data clock. The TFT conditioning circuit is disposed on the substrate and coupled to the display driver. The TFT conditioning circuit includes one or multiple thin-film transistors, and attenuates an amplitude of a serial data clock in response to a predetermined gate bias to provide the conditioned serial data clock to the display driver.

The above and other aspects of the invention will become better understood with regard to the following detailed description of the preferred but non-limiting embodiments. The following description is made with reference to the accompanying drawings.

DETAILED DESCRIPTION OF THE INVENTION

Figure 1:
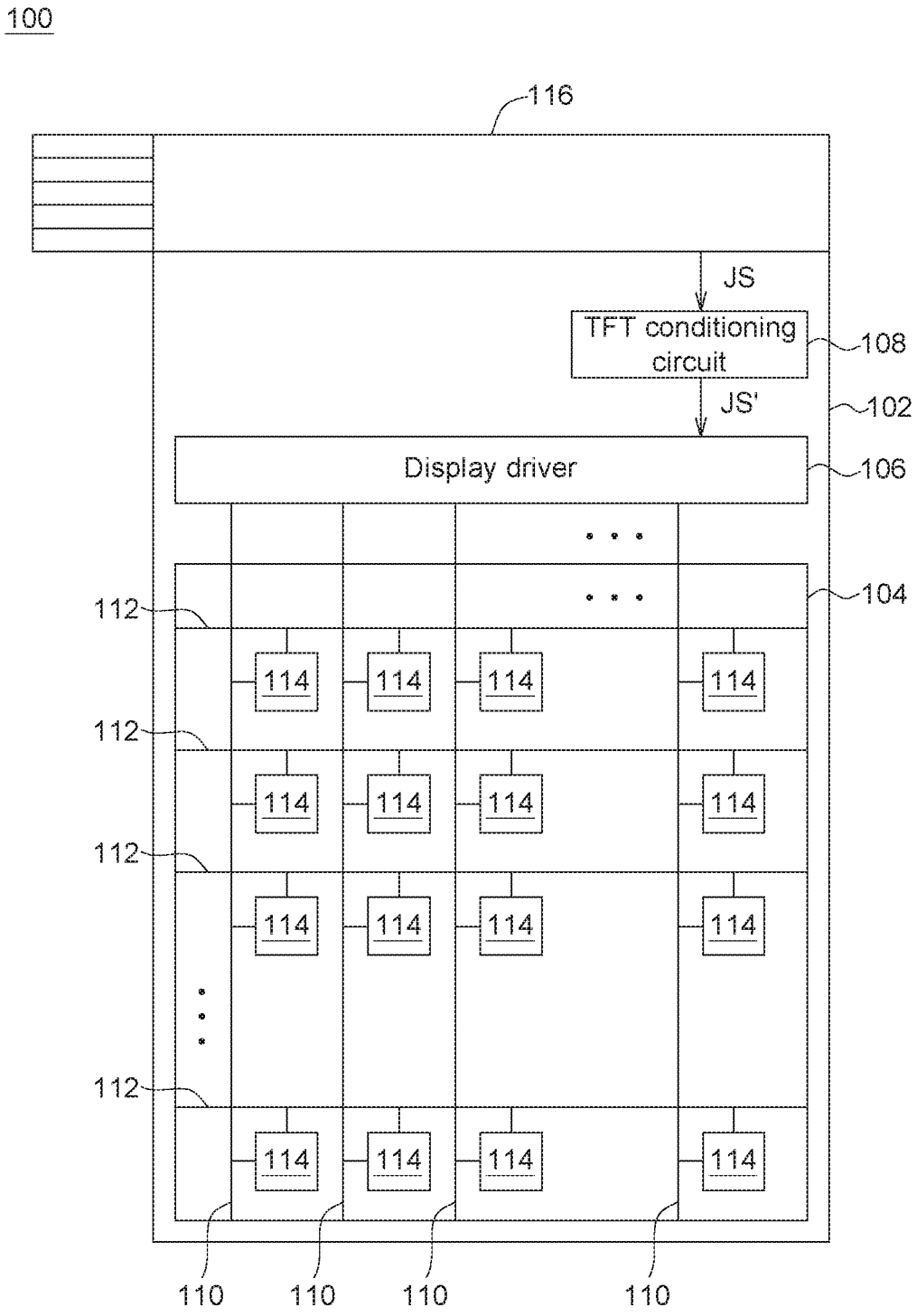
FIG. 1 is a block diagram showing a display device according to an embodiment of this disclosure.

FIG. 1 is a block diagram showing a display device 100 according to an embodiment of this disclosure. The display device 100 may be any type of display, and mainly includes a substrate 102, an active matrix 104, a display driver 106 and a thin-film transistor (TFT) conditioning circuit 108. The display device 100 may further include a printed circuit board 116.

The active matrix 104 is disposed on the substrate 102, and includes multiple data lines 110, multiple gate lines 112 and multiple pixels 114. The data lines 110 intersect with the gate lines 112, wherein the pixels 114 are coupled to intersections of the data lines 110 and the gate lines 112 to form a pixel array disposed in a display area of the substrate 102.

The display driver 106 is disposed on the substrate 102, and generates signals for driving the data lines 110 and/or the gate lines 112 in response to a conditioned serial data clock JS'. The display driver 106 may be a data driver, a gate driver or a combination of both of them. Although FIG. 1 shows that the display driver 106 is coupled to the data line 110 to function as the data driver, it is noted that the display driver 106 may also be coupled to the gate line 112 to function as the gate driver, or is coupled to the data line 110 and the gate line 112 to function as a common driver of both of them. Compared with the active matrix 104, the display driver 106 is disposed in a non-display area that is shielded on the substrate 102.

The conditioned serial data clock JS' is the result generated after a serial data clock (SDCLK) JS is attenuated. The conditioned serial data clock JS' may be generated through the TFT conditioning circuit 108. As shown in FIG. 1, the TFT conditioning circuit 108 is disposed on the substrate 102 and coupled to the display driver 106 (e.g., disposed in the non-display area on the substrate 102). The TFT conditioning circuit 108 may include one or multiple thin-film transistors controlled by a predetermined gate bias. The TFT conditioning circuit 108 may attenuate an amplitude of the serial data clock JS in response to the predetermined gate bias to provide the conditioned serial data clock JS' to the display driver 106. The thin-film transistor in the TFT conditioning circuit 108 may be manufactured in the same process as those for the active array 104, for example. The detailed circuit of the TFT conditioning circuit 108 will be described in conjunction with FIGS. 2, 3 and 4.

The conditioned serial data clock JS'/the serial data clock JS determines a work clock of the display driver 106. The display driver 106 may generate the data signals for driving the data lines 110 and/or the gate signals for driving the gate lines 112 according to the conditioned serial data clock JS'.

The EMI effect in the display device 100 can be effectively suppressed through the above-mentioned configuration. Further, the research has found that the serial data clock JS from the display signal source (not shown in the figure) is often a high-frequency signal (e.g., the frequency is about 50 MHz), and if the serial data clock JS is directly provided to the display driver 106 to function as the work clock, then the serial data clock JS will become one of main sources of EMI. Because there are highly positive correlations between the EMI and the amplitude and frequency of the electronic signal, the EMI of the display device 100 can be effectively reduced by properly attenuating the amplitude of the serial data clock JS, and then providing the attenuated result (i.e., the conditioned serial data clock JS') to the display driver 106 for use.

According to one aspect of this disclosure, the display driver 106 and the TFT conditioning circuit 108 can be regarded as a display driving circuit disposed on the substrate 102 of the display device 100. In an embodiment, the display driver 106 may be a chip, and the TFT conditioning circuit 108 is coupled to the pin of the chip originally used to receive the serial data clock JS in the display driver 106.

The printed circuit board 116 is coupled to the TFT conditioning circuit 108. The printed circuit board 116 may provide the serial data clock JS to the TFT conditioning circuit 108. The printed circuit board may be a flexible printed circuit (FPC) board functioning as the signal transmission interface between the electronic element on the substrate 102 and the external display signal source.

According to the disclosure of this embodiment, the TFT conditioning circuit 108 can be implemented by one or multiple thin-film transistors. The gate or gates of the one or multiple thin-film transistors may present a turn-on resistance ($R_{ON}$) in response to a predetermined gate bias, thereby properly attenuating the received serial data clock JS into the conditioned serial data clock JS'.

Different embodiments of the TFT conditioning circuit will be described in conjunction with FIGS. 2 to 4 in the following. It is to be noted that the embodiments are illustrative but not restrictive, and the embodiments can be properly modified and/or combined in some applications.

Figure 2:
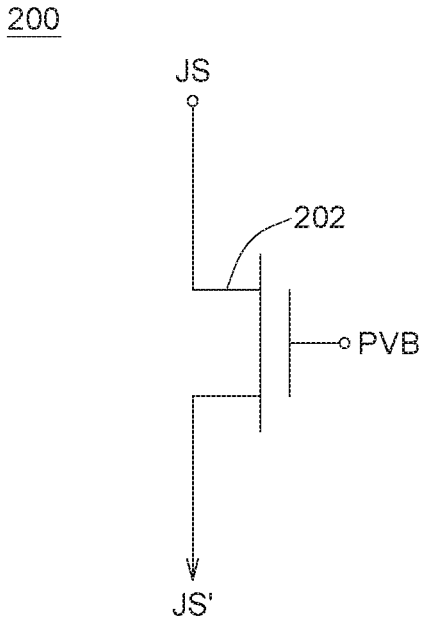
FIG. 2 is a circuit diagram showing a TFT conditioning circuit according to an embodiment of this disclosure.

FIG. 2 is a circuit diagram showing a TFT conditioning circuit 200 according to an embodiment of this disclosure. In this embodiment, the TFT conditioning circuit 200 includes a single thin-film transistor 202. The thin-film transistor 202 is connected between the serial data clock JS and the conditioned serial data clock JS', and controlled by the predetermined gate bias PVB. For example, one terminal (e.g., a drain/source) of the TFT 202 is coupled to the printed circuit board 116 to receive the serial data clock JS, and the other terminal (e.g. a source/drain) of the TFT 202 is coupled to the display driver 106 to provide the conditioned serial data clock JS' thereto.

The magnitude of the predetermined gate bias PVB is planned to make the TFT 202 present a turn-on resistor. Therefore, compared with the serial data clock JS, the amplitude of the conditioned serial data clock JS' will be attenuated. The attenuated degree of the amplitude of the conditioned serial data clock JS' may depend on the chip determination voltage of the display driver 106. For example, the attenuated degree of the amplitude of the conditioned serial data clock JS' is required to enable the attenuated level of the conditioned serial data clock JS' to be still recognized by the display driver 106, and the level shifting characteristic and the serial data clock JS before the conditioning are still consistent. In other words, the TFT conditioning circuit 200 does not change the display operation characteristic of the display driver 106.

Figure 3:
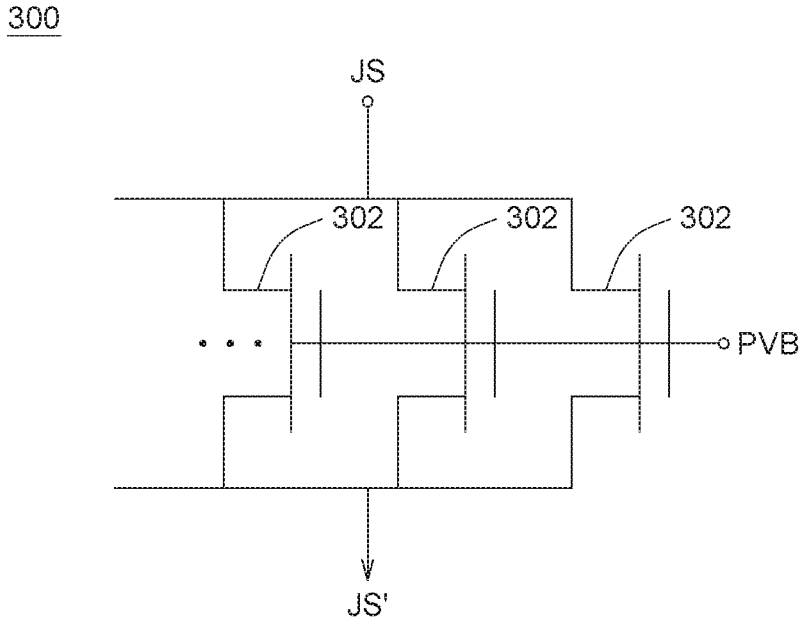
FIG. 3 is a circuit diagram showing a TFT conditioning circuit according to another embodiment of this disclosure.

FIG. 3 is a circuit diagram showing a TFT conditioning circuit 300 according to another embodiment of this disclosure. In this embodiment, the TFT conditioning circuit 300 includes multiple thin-film transistors 302 connected in parallel, and each of the thin-film transistors 302 is connected between the serial data clock JS and the conditioned serial data clock JS', and controlled by the predetermined gate bias PVB.

For example, one terminal (e.g., a drain/source) of each of the thin-film transistors 302 is coupled to the printed circuit board 116 to receive the serial data clock JS, and the other terminal (e.g., a source/drain) is coupled to the display driver 106 to provide the conditioned serial data clock JS' to the display driver 106. The predetermined gate bias PVB is applied to control terminals (e.g., gates) of the thin-film transistors 302 to control the equivalent turn-on resistance of the TFT conditioning circuit 300.

Figure 4:
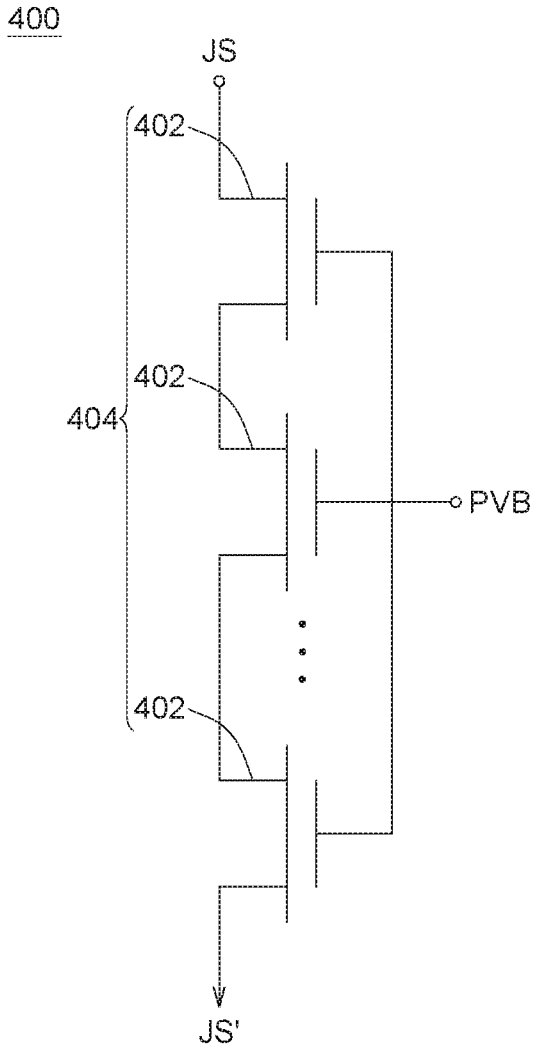
FIG. 4 is a circuit diagram showing a TFT conditioning circuit according to still another embodiment of this disclosure.

FIG. 4 is a circuit diagram showing a TFT conditioning circuit 400 according to still another embodiment of this disclosure. In this embodiment, the TFT conditioning circuit 400 includes multiple thin-film transistors 402 connected in series to form a TFT string 404. The TFT string 404 is connected between the serial data clock JS and the conditioned serial data clock JS', and controlled by the predetermined gate bias PVB.

For example, the first and last thin-film transistors 402 in the TFT string 404 may be respectively coupled to the printed circuit board 116 and the display driver 106 to receive the serial data clock JS from the printed circuit board 116, and to output the conditioned serial data clock JS' to the display driver 106. The predetermined gate bias PVB may be applied to control terminals (e.g., gates) of the thin-film transistors 402 to control the equivalent turn-on resistor of the TFT string 404.

Figure 5:
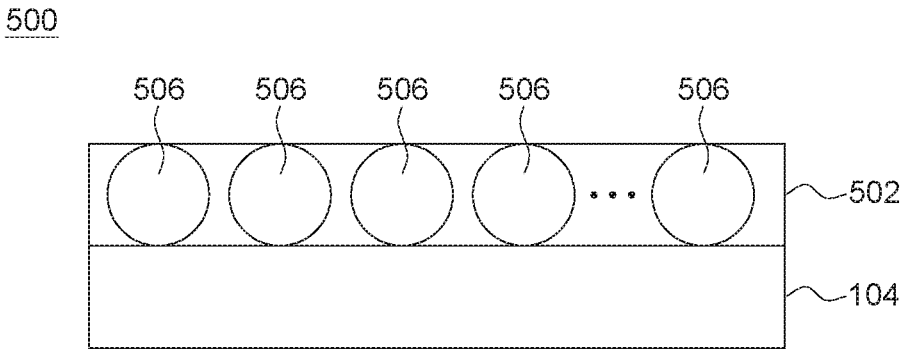
FIG. 5 is a cross-sectional view showing a display device according to an embodiment of this disclosure.

FIG. 5 is a cross-sectional view showing a display device 500 according to an embodiment of this disclosure. The configuration of the display device 500 is the same as that of the display device 100 in FIG. 1, and further includes an electronic ink layer 502 to function as an electronic paper display. The electronic ink layer 502 may be stacked over the active matrix 104. The electronic ink layer 502 includes multiple electronic ink units 506. Each of the electronic ink units 506 may have a bistable/multi-stable property, so that the image can be continuously retained after being written. For example, the electronic ink unit 506 may be implemented by a liquid with charged particles. The charged particles may be moved in the liquid by the application of the electric field to the electronic ink unit 506. The charged particles may have different colors, such as black and white.

Therefore, by driving the electrodes in the active matrix 104 to control the upward floating of the charged particles with the colors to be displayed, the electronic ink layer 502 can display an image to be presented.

According to the disclosure of this embodiment, a display device and a display driving circuit with the EMI suppression capability are provided. The research has found that the serial data clock conventionally used in the display device is one of the main sources of EMI. Therefore, the EMI can be effectively reduced by properly attenuating the serial data clock provided to the display driver, so that the display device can pass the EMI test. In addition, the attenuation of the serial data clock in the embodiment of this disclosure is implemented through the TFT elements. The TFTs may be disposed on the substrate of the display device and function as the variable resistors to attenuate the strength of the serial data clock. In this manner, when the display device cannot pass the EMI test, the developer needs not to redesign the circuit board, and only needs to adjust the predetermined gate bias provided to the thin-film transistor, so that the problem of the EMI can be improved. Because the signal intensity of the serial data clock is properly attenuated, the electric power consumption can also be reduced during the operation of the display device.

While the invention has been described by way of example and in terms of the preferred embodiments, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A display device, comprising:

a substrate;

an active matrix disposed on the substrate, wherein the active matrix comprises a plurality of data lines, a plurality of gate lines and a plurality of pixels, the data lines intersect with the gate lines, and the pixels are coupled to intersections of the data lines and the gate lines;

a display driver disposed on the substrate, wherein the display driver generates signals for driving the data lines and/or the gate lines in response to a conditioned serial data clock; and a thin-film transistor (TFT) conditioning circuit disposed on the substrate and coupled to the display driver, wherein the TFT conditioning circuit comprises at least one thin-film transistors, and attenuates an amplitude of a serial data clock in response to a predetermined gate bias to provide the conditioned serial data clock to the display driver, wherein the at least one thin-film transistor is connected between the serial data clock and the conditioned serial data clock, and controlled by the predetermined gate bias.

2. The display device according to claim 1, wherein the TFT conditioning circuit comprises the thin-film transistors connected in parallel.

3. The display device according to claim 1, wherein the TFT conditioning circuit comprises the thin-film transistors connected in series to form a TFT string.

4. The display device according to claim 1, wherein the TFT conditioning circuit is implemented by the single thin-film transistor.

5. The display device according to claim 1, further comprising:

a printed circuit board coupled to the TFT conditioning circuit, wherein the printed circuit board provides the serial data clock to the TFT conditioning circuit.

6. The display device according to claim 1, further comprising:

an electronic ink layer stacked over the active matrix.

7. A display driving circuit for driving an active matrix of a display device, the display driving circuit comprising:

a display driver disposed on a substrate, wherein the display driver generates signals for driving the active matrix in response to a conditioned serial data clock; and a thin-film transistor (TFT) conditioning circuit disposed on the substrate and coupled to the display driver, wherein the TFT conditioning circuit comprises at least one thin-film transistors, and attenuates an amplitude of a serial data clock in response to a predetermined gate bias to provide the conditioned serial data clock to the display driver, wherein the at least one thin-film transistor is connected between the serial data clock and the conditioned serial data clock, and controlled by the predetermined gate bias.

8. The display driving circuit according to claim 7, wherein the TFT conditioning circuit comprises the thin-film transistors connected in parallel.

9. The display driving circuit according to claim 7, wherein the TFT conditioning circuit comprises the thin-film transistors connected in series to form a TFT string.

10. The display driving circuit according to claim 7, wherein the TFT conditioning circuit is implemented by the single thin-film transistor.

* * * * *